US005137081A

United States Patent [19]

Klaren

[11] Patent Number: 5,137,081

[45] Date of Patent: Aug. 11, 1992

[54] METHOD FOR CLEANING THE WALLS OF HEAT EXCHANGERS, AND HEAT EXCHANGER WITH MEANS FOR SAID CLEANING

[75] Inventor: Dick G. Klaren, Hillegom, Netherlands

[73] Assignee: Eskla B.V., Schiedam, Netherlands

[21] Appl. No.: 686,826

[22] Filed: Apr. 17, 1991

[30] Foreign Application Priority Data

Apr. 18, 1990 [NL] Netherlands ..... 9000919

[51] Int. Cl.[5] ..... F28G 1/12; B08B 9/04

[52] U.S. Cl. ..... 165/95; 15/3.5; 15/3.51

[58] Field of Search ..... 165/95; 15/3.5, 3.51

[56] References Cited

U.S. PATENT DOCUMENTS

| | | | |
|---|---|---|---|
| 2,801,824 | 8/1957 | Taprogge | 257/1 |
| 4,079,782 | 3/1978 | Soderberg et al. | 165/95 |
| 4,237,962 | 12/1980 | Vandenhoeck | 165/95 |
| 4,366,855 | 1/1983 | Spitz | 165/95 |
| 4,476,917 | 10/1984 | Otake et al. | 165/95 |
| 4,531,570 | 7/1985 | Dries | 165/95 |
| 4,562,885 | 1/1986 | Pausch | 165/95 |
| 4,569,097 | 2/1986 | Echols | 165/95 |

FOREIGN PATENT DOCUMENTS 2818006 9/1979 Fed. Rep. of Germany .

*Primary Examiner*—John Rivell
*Assistant Examiner*—L. R. Leo
*Attorney, Agent, or Firm*—Webb, Burden, Ziesenheim & Webb

[57] ABSTRACT

For cleaning at least one of the sides of the essentially vertical heat-transmitting walls between two fluids in a heat exchanger, solid particles are introduced into a stream of fluid, which particles are smaller than the distance between opposite walls defining the flow of fluid, said fluid with particles being introduced into part of a collection or distribution space above said walls and said particles being collected below said vertical walls and discharged from the heat exchanger. The particles are so heavy that they move downwards in the fluid even if this has an upward direction of flow between the walls. The particles are introduced above only part of the transverse plane above the vertical walls and switch means allow switching of said introduction to other parts of said transverse plane periodically. Thereby, the normal operation of the heat exchanger can continue with hardly any pressure loss during cleaning.

16 Claims, 4 Drawing Sheets

METHOD FOR CLEANING THE WALLS OF HEAT EXCHANGERS, AND HEAT EXCHANGER WITH MEANS FOR SAID CLEANING

The invention relates to a method for cleaning at least one of the sides of the essentially vertical heat-transmitting walls between two fluids of a heat exchanger conveyed along opposite sides of said walls, and to a heat exchanger with means for said cleaning. In this case heat exchangers must be understood in a wide sense, for example also including devices for carrying out under heat exchange all kinds of physical and chemical processes, such as catalytic or enzymatic processes, processes with inoculants or solid inoculation particles for grain growth, microbiological cleaning processes etc. In this case a closed flow, filling up the space between opposite walls, can run along the walls to be cleaned, or a film as in the case of film evaporators.

The invention proposes achieving such cleaning by solid particles which clean the walls while moving along them, without interrupting the operation of the heat exchanger. The invention is intended for both heat exchangers with ascending and those with descending flow along the walls to be cleaned, the relevant particles in the first case being so large and heavy that, despite the upward medium flow, they can also in this case descend along said walls.

All kinds of different materials can be used for the particles, for example of metal or glass. The metal selected is a metal or alloy which is not corroded by the heat-exchanging medium, and which does not have an adverse effect on the latter.

In order to achieve this, a method of the type mentioned in the preamble is according to the invention characterized in that solid particles are introduced into a stream of fluid being essentially the same or being one phase of one of the fluids, which is undergoing heat exchange at that one side of said walls, said particles being smaller than the distance between opposite walls defining the flow of said fluid, in that said fluid with said particles is moved to a zone above said vertical walls into a part of a collection or distribution space for said fluid covering only part of the horizontal transverse plane of said vertical walls, said particles being collected below said vertical walls and discharged from the heat exchanger, which particles are so heavy and large that they move downwards along said walls and after discharge and possible cleaning are fed fully or partially back with said fluid stream to above said vertical walls, the flow of said particles with said fluid in each case being moved periodically to in each case a different part of said collection or distribution space covering a different horizontal transverse plane part above said vertical walls.

A thorough cleaning during operation of the heat exchanger in many divergent applications is found to be possible in this way. The expert can determine specific weight, size and shape of the solid particle easily for each case and adapt these to the heat exchanging medium, the specific weight, the viscosity and the flow direction and flow velocity thereof, in such a way that said particles fall along the walls to be cleaned, but so slowly that they can clean the walls thoroughly.

A heat exchanger of the type referred to is according to the invention characterized in that means are fitted for bringing a partial stream of one of the fluids in a collection or distribution space above said walls with solid particles therein, smaller than the distance between opposite walls defining the flow of said fluid and heavy and large enough to move downwards along the side of those walls along which said fluid flows for heat exchange, with means for discharging said fluid with solid particles out of a distribution or collection space at the bottom of said walls and returning it fully or partially to said collection or distribution space, means being provided for taking the stream with solid particles in each case over a part of the total transverse surface of the vertical walls said collection or distribution space, and in which switch means are provided for periodically switching the feed of said particles to the distribution or collection space above said walls, in order to feed another part of said transverse surface with said particles.

It is remarked that it is known to use solid particles to clean the tubes of heat exchangers. For cleaning the inside of tubes of heat exchangers it is known from U.S. Pat. No. 2,801,824 to apply solid particles being elastic balls of a diameter the same as the inner diameter of the tubes to be cleaned or of a larger diameter. They are thus "pumped" through the tubes together with the fluid taking part in the heat exchange. This system is improved by feeding the balls to only part of the total transverse surface of the heat exchanger, so to only part of the tubes to be cleaned, at the same time and to switch from one surface part to another from time to time (DE-B-2,818,006).

This system requires flow of the balls in the same direction as the fluid taking part in the heat exchange and the heat exchange flow is considerably impeded by these balls.

When applying the present invention the normal operation of the heat exchanger can go on during the cleaning with hardly any lessening of heat exchange or even augmenting thereof and with hardly any pressure loss. It is possible to have the particles move downwards both in a rising and in a downwardly directed stream of fluid.

The invention makes it possible for a thorough cleaning to-introduce a strong concentration (relatively large quantity) of such solid particles, while the heat exchange proceeds virtually unimpeded or is even reinforced. In the case of a rising medium stream said medium stream will become weaker over the part of said horizontal transverse plane where the particles are falling, but said stream, seeking the route of least resistance, is not impeded in the part of the heat exchanger not taking part in the cleaning at the time and, depending on the circumstances, may even become stronger, while no additional pump or fan capacity for the main stream of the medium is necessary. This also has great benefits if the medium flowing along the walls to be cleaned is ascending and occurs in two phases, as in the case of an evaporator or a re-evaporator behind or below a distillation column in the petroleum industry. Boiling is then suppressed locally, but continues in a large part of the device without causing appreciable additional pressure loss.

The invention will now be explained in greater detail with reference to appended schematic drawings, in which.

Figure 1:
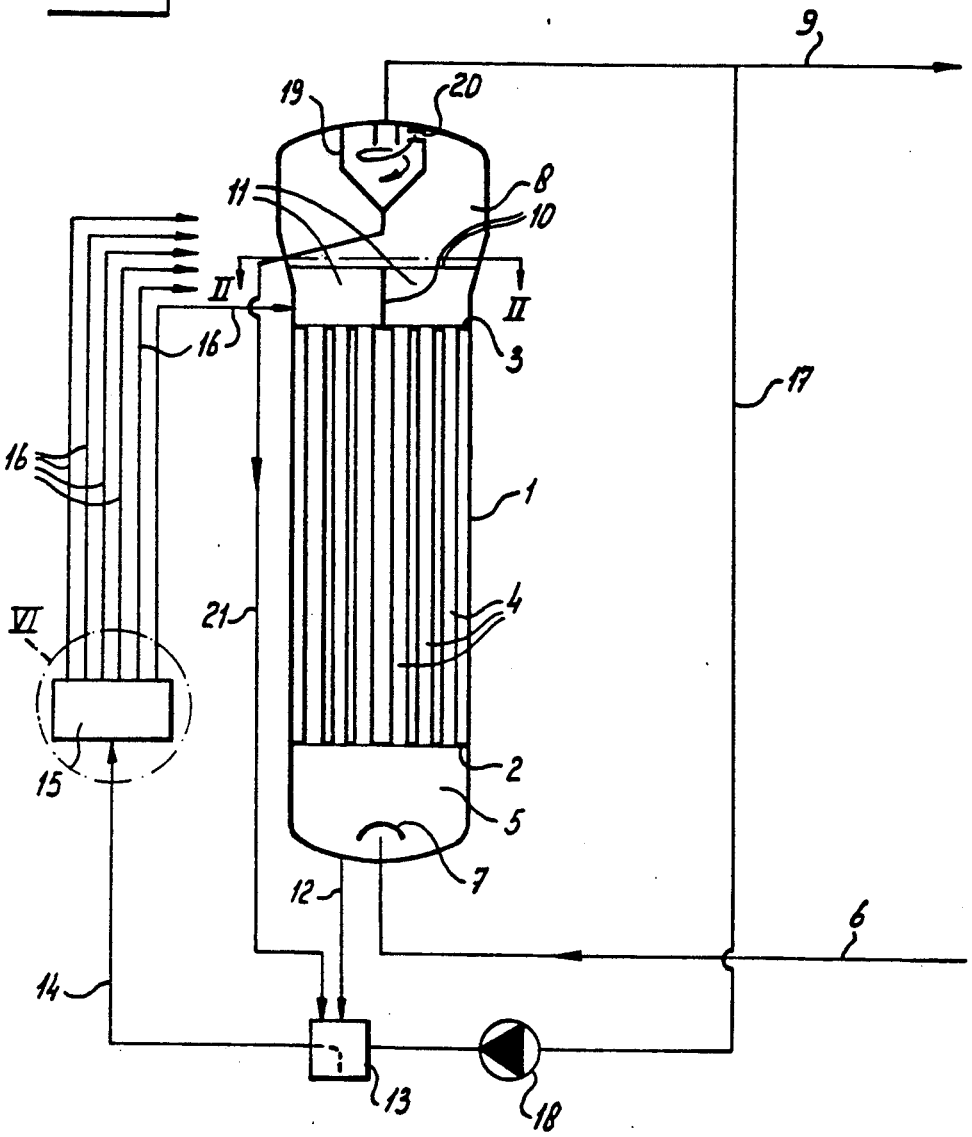
FIG. 1 is a vertical section through a shell-and-tube heat exchanger with ascending flow of the medium through the tubes and with cleaning of its interior.
Figure 2:
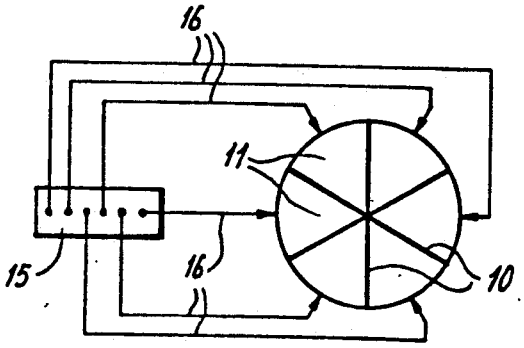
FIG. 2 is a horizontal section and downward view along the line II—II in FIG. 1.

The heat exchanger of FIGS. 1 and 2 has in a housing 1 a bottom tube plate 2 and a top tube plate 3, between which a number of vertical tubes 4 extend. Below the bottom plate 2 a distribution space 5 is formed, into which medium is fed through a pipe 6, which medium must flow upwards through the tubes 4 for heat exchange with a medium which is fed through the housing 1 between the tube plates around the tubes through inlets and outlets (not shown), and which moves, for example, in a zigzag path between inlet and outlet through horizontal partitions which grip round the tubes, but do not take up the whole horizontal surface of the housing 1, as known.

The inlet of pipe 6 into space 5 is covered by a cap 7, in order to ensure better distribution of the inflowing medium and to prevent solid particles, to be described below, from entering said pipe 6.

Situated above the tube plate 3 is a collection space 8, from which the medium is discharged from the tubes through a pipe 9.

On top of the tube plate 3 is a set of plates which are combined to a star-shaped member 10, and which divide the horizontal cross-section of the housing, which in this case is of circular design, into, for example, six sectors 11.

Connecting to the bottom of the distribution space 5 is a discharge pipe 12 leading to a collector 13 for solid particles, and from there a pipe 14 leads to a distributor 15. The latter has a switch valve, for example rotating about a vertical axis (vide FIG. 6), which admits the incoming stream flowing through the pipe 14 to only one of the pipes 16 at any moment. Each of the six pipes 16 connects to a different sector 11 above tube plate 3. The pipes 16 are shown individually in FIG. 1, but not all drawn through to a sector, and are shown with their horizontal top ends above one another, although said top ends can lie in the same plane in the manner shown in FIG. 2.

A pipe 17 branches off from discharge pipe 9 and leads to a pump, fan or compressor 18, which forces medium from said feed or discharge pipe to the collector 13. The feed pipe 6 can, of course, also contain a pump or compressor, but where there is an upward flow through the tubes produced by thermosiphon action this can be superfluous.

The cleaning action of this heat exchanger now takes place as follows. Solid particles for cleaning are brought at a suitable point into the circulation system 12, 13, 14, 15, 16, 11. The medium, placed under pressure by pump or the like 18, cannot transmit its pressure to pipe 12—or can do so only in a throttled way—for example through the fact that the latter opens into the collector 13 in an injector directed towards pipe 14, and a lock or cellular wheel (not shown) is provided in pipe 12. A flow is thus produced through pipe 14 to distributor 15, and from there through the pipe 16 open at that moment to one of the sectors 11 above the tube plate 3. This flow is selected to be so strong that the solid particles mentioned flow up with it and thus reach one of the sectors 11, from where they fall into the tubes 4 of that sector and move downwards in said tubes. In distribution space 5, in which the flow of the incoming heat exchanging medium is less than in the tubes 4, said solid particles settle and collect and then flow back through the pipe 12 into the lowest point of said space 5 to collector 13.

The pipes 16 preferably open radially inward into the sectors 11, so that the solid particles are distributed as uniformly as possible in and over each sector. The pump 18 can also act in a pulsating manner, or a flow variator can be fitted in the distributor 15, for example a linearly moving or rotating slide with an opening which can be moved in front of each of the pipes 16, and which, for example, first admits the pressure from pipe 14 virtually unthrottled into the pipe 16 concerned and on further movement gradually throttles it to a greater degree, or vice versa. The solid particles are thus distributed as well as possible over the sector 11 concerned, due to the fact that they are first in particular conveyed far towards the centre of the star-shaped member 10 and thereafter gradually more towards the outer zones of the sector, or vice versa.

The medium flowing through the tubes 4 can be a gas or a liquid. In the case of a gas the solid particles are preferably lighter than in the case of a liquid, so that they never fall too fast through the tubes 4 and, in the case of a gas, the compressor or fan 18 need not generate too strong a flow through the parts 13, 14, 15 and 16 in order to carry the solid particles along and up, and thus does not needlessly require a large amount of energy. In the case of a gas a suction fan could be fitted in the discharge pipe 9.

The flow in the tubes can also be directed downwards, contrary to what is shown in the drawing. Preferably, lighter and/or smaller solid particles than those in an upward flow are then used.

In the case of upward flow of the medium through the tubes there is generally a chance of the particles being thereby conveyed upward along with it and leaving the device at the top end. This can be prevented by a suitable separator. In FIG. 1 a cyclone 19 with tangential inlet 20 is provided for this purpose, through which inlet the medium has to pass in order to reach the discharge pipe 9. Depending on the type of medium, this is a gas or a liquid cyclone. The solid particles trapped in it are returned through pipe 21 to the collector 13.

Figure 3:
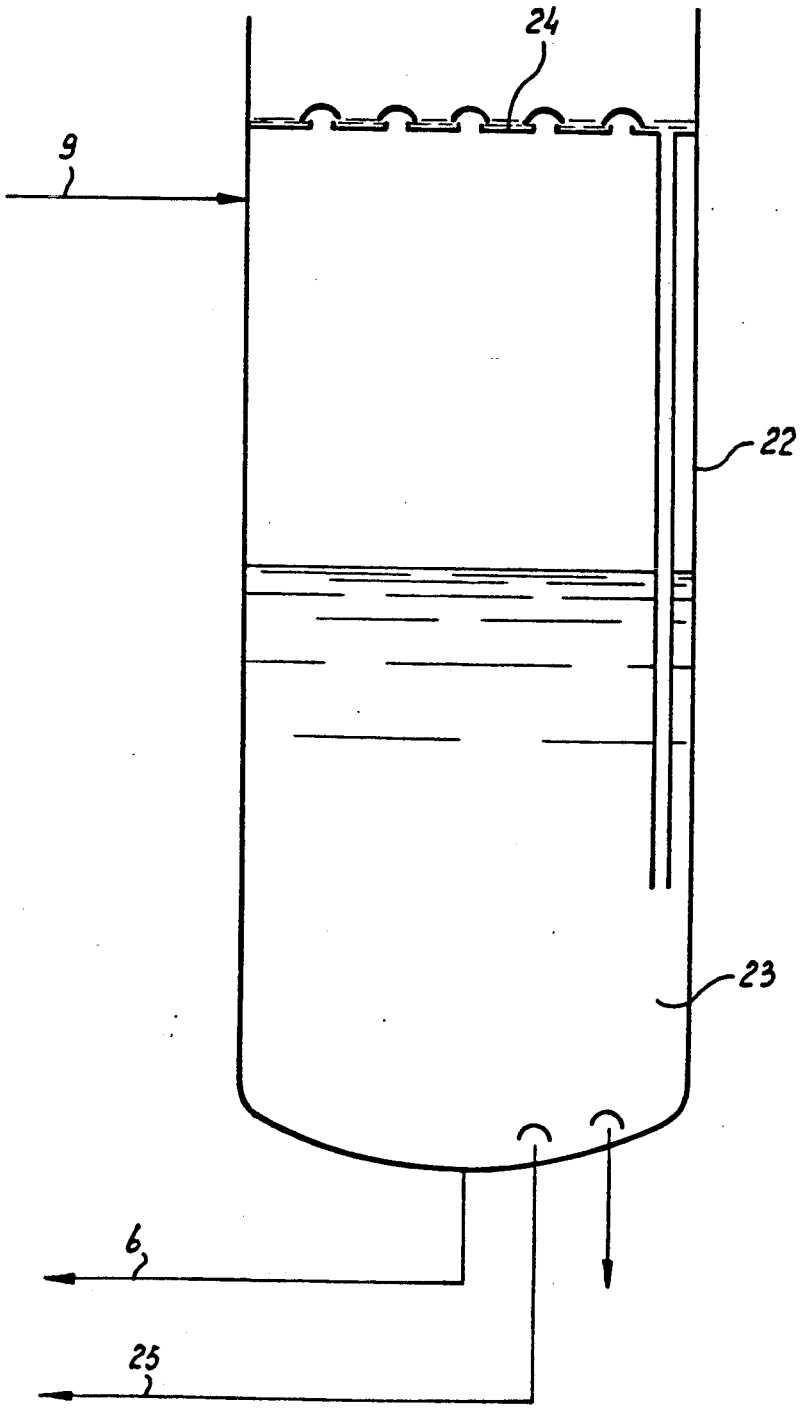
FIG. 3 is a vertical schematic section through the bottom end of a distillation column with connections to a re-evaporator (not shown) which is essentially the same as the heat exchanger of FIGS. 1 and 2.

FIG. 3 shows schematically the bottom end 22 of a distillation column for petroleum. The viscous residue 23 in the bottom of it can be conveyed for re-evaporation through pipe 6 to a re-evaporator which is in principle of the same design as the heat exchanger of FIG. 1. The discharge line 9 of this re-evaporator leads back to the top of the space 22 below the bottom bubble plate 24. The re-evaporator can operate with natural circulation.

The medium used to feed in to the re-evaporator the solid particles for cleaning it can here be derived from the bottom of the distillation column through pipe 25, so that the pipe 17 of FIG. 1 is not necessary. Thus no cyclone 19 or similar separator in the top of the re-evaporator is necessary either. Any solid particles carried along out of the top of the re-evaporator pass through pipe 9 into the distillation column, which if the material of the solid particles is selected well is no problem because they can collect in the bottom of said column and can flow back again to the re-evaporator through pipe 6. The natural circulation means that no pump is needed in pipe 6. Pipe 25, which leads to pump 18 (FIG. 1) does, however, have to be placed and shielded in such a way that the solid particles cannot enter into it.

Figure 4:
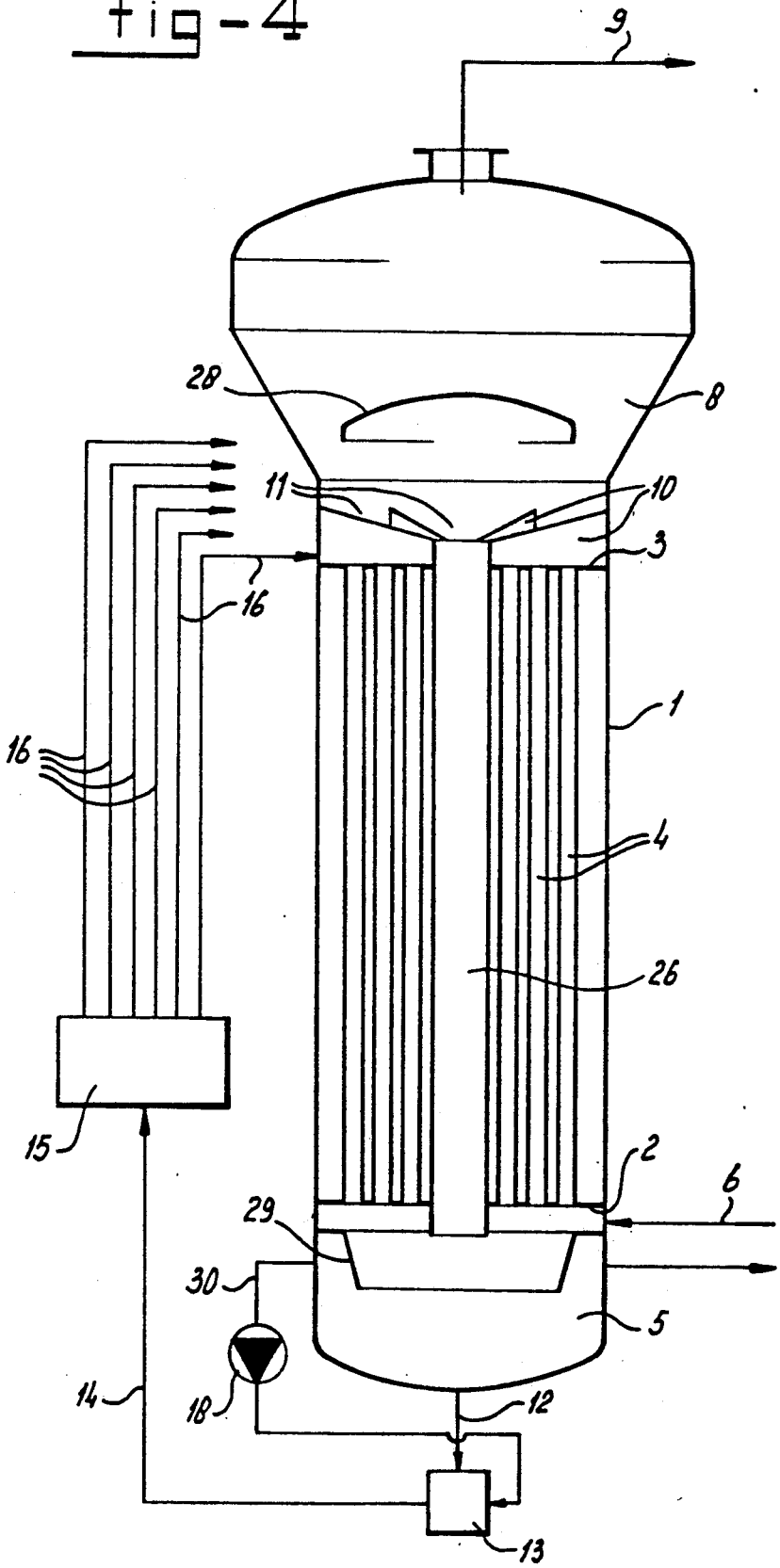
FIG. 4 is a vertical section through an evaporator.

FIG. 4 shows an evaporator which is equipped according to the invention. Apart from the same parts as those shown in FIG. 1, it has a central downpipe 26 and a cap 28 above it, so that a vapour/liquid separation which is known in principle is obtained in the top collection space 8, in which solid particles carried up are also sufficiently retained and will not be able to leave the evaporator through the outlet 9 with the vapour.

The liquid feed through pipe 6 can take place above a protective edge 29, below which a pipe 30 can drain off, in order to convey a part of the liquid to pump 18 and from there to collector 13, from where it carries along the solid particles coming out of pipe 12 to pipe 14 and distributor 15 etc., as in the case of FIG. 1. So here again there is a star-shaped element 10 for forming sectors 11 to which the pipes 16 connect.

Figure 5:
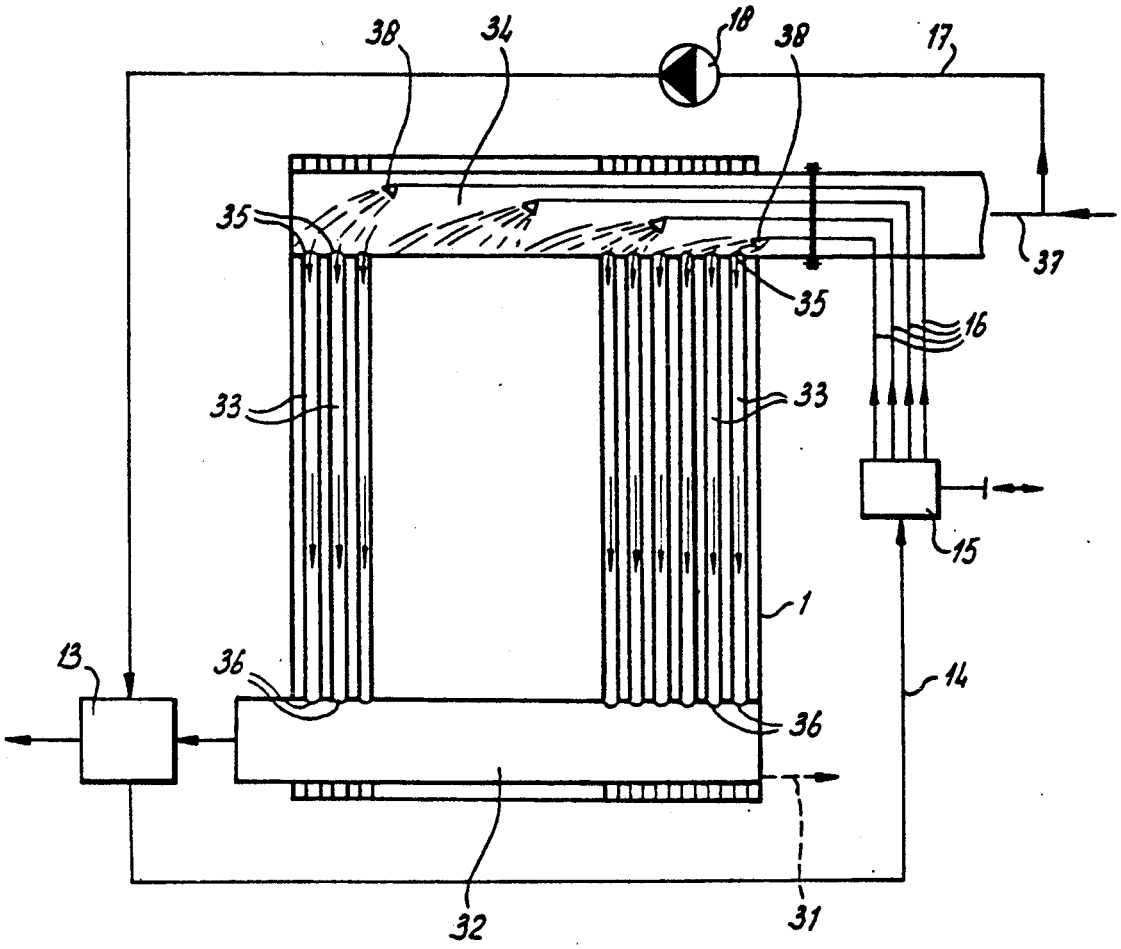
FIG. 5 is a vertical "staggered" section at right angles to the plates of a plate heat exchanger with countercurrent and downward flow in the spaces between the plates, which are cleaned through application of the invention.

FIG. 5 shows a plate heat exchanger of a type which is known per se. Such a heat exchanger has essentially vertical plates along which one medium flows at one side and the other medium at the other side, between which media heat exchange has to take place. The plates and the housing are in this case essentially rectangular with rounded edges and near each corner there is a common feed or discharge pipe for one or the other medium. One medium in this case flows from a common feed pipe into a left corner at the top or bottom to a common discharge pipe in a right corner at the bottom or top, and the other medium then flows from a common feed pipe, for example in the other left corner, to a common discharge pipe in the other right corner, but it can also flow from right to left. A countercurrent is thus produced, in which each flow is a combination of a transverse flow and a vertical flow, and in which one flow can run in the transverse direction and/or in the vertical direction in the same direction as or in counterflow to the other flow. FIG. 5 shows such a heat exchanger, in which the walls of the plates to be cleaned are in contact with the medium going down. If the invention is applied here to a rising flow, then it becomes more difficult to remove the descending solid cleaning particles from the bottom distribution space, which can then be carried out by, for example, draining off a part of the medium at 31 from the bottom collection space 32 during the cleaning and conveying that stream to collector 13.

In FIG. 5 the vertical section is staggered, in other words, it is shown for the same medium through the feed and discharge space (distribution or collection space), although they do not normally lie directly above one another, but one is at the top left and the other is at the bottom right in the heat exchanger.

We can see here in the housing 1 the plates 33, the distribution space 34, with openings 35 to alternately every one of two adjacent spaces between the plates, and the openings 36 to the collection space 32 at the bottom. We can also see the feed pipe 37 for medium to distribution space 34, the drain pipe 17 from it with pump 18, the collector 13 for the solid particles from the flow from the collection space 32, the pipe 14 to the distributor 15 and pipes 16 (in this case four) from there to feed points 38 for the drained-off medium with solid particles to different places above the plates 33 in the distribution space 34. They can be spray heads with openings large enough to allow through the solid particles, and with a flow pattern so that there is no risk of blockage, thus for example with a delivery nozzle with a single opening, slightly larger than the feed pipe 16 itself. Also in the case of such a single opening the solid particles are distributed in the medium flow in distribution space 34 by being carried along by it, in such a way that they reach a number of openings 35 very regularly distributed. A different group of openings 35 can in each case be provided with said solid particles by switching the distributor 15 over. The same system can be used for the other walls of the plates, through allowing solid particles into the distribution space on top for the other medium.

It can be seen from the above that the invention can be used in widely differing cases of heat exchange and types of heat exchangers, with forced circulation or thermosiphon flow, with falling or rising flows, and with cleaning of one or both walls of tubes or plates between the heat-exchanging media. In the case of the re-evaporator described, operating according to the system of FIG. 1, or in the case of the evaporator of FIG. 4, the solid particles with a little medium in the sector 11 into which they are fed will fully or partially suppress boiling in the corresponding tubes 4, but that is no problem for the continued normal operation of the heat exchanger during cleaning, since in the other sectors boiling continues normally. In that case, as in a number of other cases, particularly two-phase systems, it is then an absolutely essential condition simultaneously to feed solid particles only over a small part of the walls in order to clean while normal heat exchange and operation continue. Of course, in many cases cleaning of one of the walls of each heat-exchanging plate or tube is enough, since in many applications the walls in contact with one heat-exchanging medium become much dirtier than those in contact with the other medium. It will generally be enough to clean only briefly in the manner indicated, with longer or shorter periods between when no cleaning is carried out. The solid particles could then be introduced along all walls of the heat exchanger, instead of by sector.

For the solid particles it is preferable to use particles with dimensions of 1 to 5 mm. In the case of the re-evaporator of FIG. 1, used with the distillation column of FIG. 3, chopped metal wire with a diameter of approx. 5 mm and a particle length of approx. 5 mm can, for example, be used. Hard, non-elastic particles are strongly preferred. In gas it is preferable to use smaller particles. In the case of plate heat exchangers according to FIG. 5, for example with seawater in contact with the walls to be cleaned, glass balls, for example, having a diameter of 1 to 2 mm can often be considered. The greatest dimension of each particle should be smaller than the distance between the opposite walls of the spaces to be cleaned, so, in the case of circular tubes, smaller than the inner diameter thereof, which makes the particles freely movable therethrough without interrupting the heat exchange in the spaces, in which they are present for cleaning.

Tubes 4 which are approximately 50 mm in diameter can be fed with solid particles in a quantity of up to several hundred kg per hour, both in the case of chopped wire and in the case of glass or other ceramic balls. Through a few simple experiments the best material and the best dimensions of the particles and the quantity per unit time to be fed in can be determined easily in each case.

The collector 13 for the solid particles coming out of the bottom of the heat exchanger can interact or be combined with a storage tank for the particles and with a separator for impurities carried along out of the heat exchanger. However, the impurities will generally leave the heat exchanger with the main flow of medium, and in the case of upward flow thereof will not go along with the solid cleaning particles. In the case of all kinds of catalytic and biochemical processes the particles will require some type of regeneration or other, continuous or periodic. The collector 13 can also have an inlet for feeding in (new) solid particles and an outlet for discharging the solid particles from the system, for example for cleaning or replacement. A possible design of the collector 13 is one in which a rotating lock at the side of pipe 12 prevents short-circuiting. The pressure of pump or fan 18 is then fully utilized in the transportation of the particles from collector 13 to distributor 15.

The collector 13 can be a tank in which the solid particles collect at the bottom, and in which the medium coming in from pipe 17 of pump or fan 18 flows downwards to an immersion pipe opening into the bottom of said tank and then upwards through said pipe to pipe 14 carrying solid particles with it.

Figure 6:
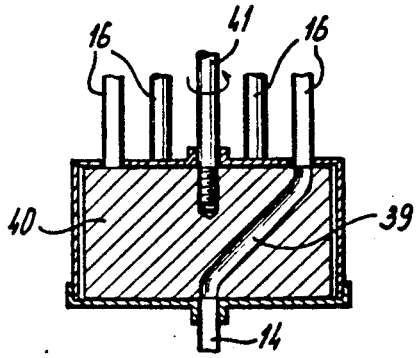
FIG. 6 gives a possible embodiment of a distributor.

The distributor 15 can comprise a linearly moving slide with a single passage, locking means for locking the slide with said passage in position with each one of the pipes 16 as desired and a movement device for said slide which can be moved manually or with, for example, a linear motor. The distributor 15 can also be, and preferably is, a rotary slide with rotary drive means, with the connections to the pipes 16 not being disposed in line with each other, but in a circle. Many embodiments of this type of distributor are known. For example, such a distributor as shown in FIG. 6 is known with a curved or slanting tube 39 in a rotary element 40, rotated by a shaft 41 with suitable drive means, preferably for stepwise movement to bring pipe 14 during a desired time interval in connection with one of the pipes 16 at a time, which tube always connects at one side to pipe 14 and at the other side on rotation of said element moves along the inlet openings of the pipes 16 which are then disposed in a circular ring.

An inlet for solid particles can be fitted at any desired point in the system, for example in collector 13, in order to begin the process and to replenish the quantity of solid particles, while a drain for said particles can also be provided at said collector 13 or elsewhere.

As can be seen from the examples described, the drain-off flow of medium for circulation of the solid particles can be drained off from the infeed or from the discharge of the main stream, depending on the circumstances.

I claim:

1. Method for cleaning at least one side of essentially vertical heat-transmitting walls between two fluids of a heat exchanger conveyed along opposite sides of said walls, in which solid particles are introduced into a stream of fluid being essentially the same or being one phase of one of the fluids, which is undergoing heat exchange at that one side of said walls, said particles being smaller than the distance between opposite walls defining the flow of said fluid, in that said fluid with said particles is moved to a zone above said vertical walls into a part of a collection or distribution space for said fluid covering only part of the horizontal transverse plane of said vertical walls, said particles being collected below said vertical walls and discharged from the heat exchanger, which particles are so heavy and large that they move downwards along said walls and after discharge and possible cleaning are fed fully or partially back with said fluid stream to above said vertical walls, the flow of said particles with said fluid in each case being moved periodically to in each case a different part of said collection or distribution space covering a different horizontal transverse plane part above said vertical walls and in which the particles are introduced between heat transmitting walls, in which the fluid flow for heat exchange is vertically upwards.

2. Method according to claim 1, in which a portion of the fluid downstream of the heat exchanger is placed under pressure to reintroduce said solid particles into the heat exchanger.

3. Method according to claim 1, in which the particles are of hard non-elastic material.

4. The method of claim 3 wherein said hard non-elastic material is metal.

5. The method of claim 4 wherein said particles are made of chopped metal wire.

6. The method of claim 3 wherein said hard non-elastic material is glass.

7. The method of claim 6 wherein said particles are made of glass balls.

8. Heat exchanger with essentially vertical heat-transmitting walls between two fluids conveyed along opposite sides of said walls, characterized in that means are fitted for bringing a partial stream of one of the fluids in a collection or distribution space above said walls with solid particles therein, smaller than the distance between opposite walls defining the flow of said fluid and heavy and large enough to move downwards along the side of those walls along which said fluid flows for heat exchange, with means for discharging said fluid with solid particles out of a distribution or collection space at the bottom of said walls and returning it fully or partially to said collection or distribution space, means being provided for taking the stream with solid particles in each case over a part of the total transverse surface of the collection or distribution space above said walls, and in which switch means are provided for periodically switching the feed of said particles to the distribution or collection space above said walls, in order to feed another part of said transverse surface with said particles, in which the fluid flow for normal heat exchange between the walls, between which the solid particles are introduced, is directed upwardly.

9. Heat exchanger according to claim 8, in which means are fitted for draining off part of the stream of fluid to or from the heat exchanger, in which a pump or the like is fitted in a drain pipe and said pipe connects to said draining means from the heat exchanger in order to convey a joint stream of said fluid with solid particles to said distribution or collection space above said walls.

10. Heat exchanger according to claim 8, in which provision is made for partitions dividing the collection or distribution space above said walls to be cleaned into sector shaped partial spaces, said switch means causing said flow of solid particles to open into a selected sector space.

11. Heat exchanger according to claim 10, in which the stream of solid particles in each sector has an inlet directed towards the point of meeting of said partitions.

12. Heat exchanger according to claim 8, in which means are fitted for altering the strength of flow of the fluid stream containing the solid particles during the feeding of each part of said total transverse surface with solid particles.

13. Heat exchanger according to claim 8, with gas rising therein between essentially vertical walls.

14. Heat exchanger with parallel, approximately vertical plates and with approximately horizontal collection and distribution spaces running over a number of plates for heat-exchanging fluid at the top and in the bottom of the heat exchanger, according to claim 8, with means for bringing the fluid stream with solid particles into a top collection or distribution space.

15. Heat exchanger according to claim 14, in which in a top distribution space for distribution of one of the heat-exchanging fluids between the plates a number of feed pipes for solid particles are fitted and have outlets at a horizontal distance from each other in order to permit in combination feeding of solid particles to all of said plates.

16. Heat exchanger according to claim 8, in which the solid particles from the heat exchanger are caught and collected in a collector into which an immersion pipe opens, which pipe connects to the means for bringing the fluid stream with solid particles into the collection or distribution space above said walls.

* * * * *